US008025279B2

(12) United States Patent
Seber

(10) Patent No.: US 8,025,279 B2
(45) Date of Patent: Sep. 27, 2011

(54) RATCHETING C-CLAMP

(75) Inventor: Brett P. Seber, Vista, CA (US)

(73) Assignee: Seber Design Group, Inc., Vista, CA (US)

( * ) Notice: Subject to any disclaimer, the term of this patent is extended or adjusted under 35 U.S.C. 154(b) by 482 days.

(21) Appl. No.: 12/170,781

(22) Filed: Jul. 10, 2008

(65) Prior Publication Data

US 2009/0014934 A1 Jan. 15, 2009

Related U.S. Application Data

(60) Provisional application No. 60/948,897, filed on Jul. 10, 2007.

(51) Int. Cl.
*B25B 1/02* (2006.01)

(52) U.S. Cl. ..... 269/143; 269/249; 269/6; 269/3; 269/207

(58) Field of Classification Search ..... 269/143, 269/249, 6, 3, 207; 29/257, 258
See application file for complete search history.

(56) References Cited

U.S. PATENT DOCUMENTS

| | | | | | |
|---|---|---|---|---|---|
| 63,468 | A | | 4/1867 | Card | |
| 625,017 | A | | 5/1899 | Brown | |
| 1,072,313 | A | | 9/1913 | Conte | |
| 1,452,753 | A | * | 4/1923 | Otto et al. | 269/189 |
| 2,316,073 | A | | 4/1943 | Kellogg | |
| 2,323,654 | A | | 7/1943 | Gordy | |
| 2,461,687 | A | * | 2/1949 | Hopfeld | 439/803 |
| 2,466,937 | A | * | 4/1949 | Downs | 269/143 |
| 2,504,373 | A | | 4/1950 | Andres | |
| 2,549,256 | A | * | 4/1951 | Sparling | 269/223 |
| 2,610,662 | A | | 9/1952 | Ratcliff | |
| 2,671,482 | A | | 3/1954 | Gordon | |
| 2,768,664 | A | * | 10/1956 | Porter | 269/203 |
| 2,768,768 | A | | 10/1956 | Cornell et al. | |
| 2,882,774 | A | | 4/1959 | Guttfeld | |
| 3,092,378 | A | * | 6/1963 | Aulner | 269/143 |
| 3,836,136 | A | | 9/1974 | Davis | |
| 4,032,109 | A | | 6/1977 | Wilson | |
| 4,185,811 | A | | 1/1980 | Long | |
| 4,220,322 | A | | 9/1980 | Hobday | |
| 4,436,294 | A | * | 3/1984 | Irelan | 269/6 |
| 4,534,547 | A | | 8/1985 | Cox | |
| 4,582,307 | A | * | 4/1986 | Wang | 269/182 |
| 4,770,401 | A | | 9/1988 | Donaldson | |
| 4,925,169 | A | * | 5/1990 | Lodrick, Sr. | 264/185 |
| 4,926,722 | A | * | 5/1990 | Sorensen et al. | 81/487 |
| 4,989,847 | A | | 2/1991 | Chapman | |
| 5,217,213 | A | | 6/1993 | Lii | |
| 5,423,525 | A | | 6/1995 | Spainhower | |
| 6,250,621 | B1 | | 6/2001 | Ping | |

(Continued)

*Primary Examiner* — George Nguyen
(74) *Attorney, Agent, or Firm* — Patterson & Sheridan, LLP

(57) ABSTRACT

A one-handed ratcheting C-clamp is provided. The C-clamp incorporates a spring loaded handle mechanically coupled to a ratcheting mechanism. The ratcheting mechanism has a plurality of gear teeth that engage the threads of a corresponding rod disposed through a hole formed in one section of the C-shaped C-clamp. The handle rotates the bidirectional ratchet such that the threaded rod is lowered or raised within the hole of the C-shaped C-clamp. A button located in the side of the handle may release the ratchet mechanism pawl to provide axial sliding engagement of the rod to a corresponding work piece. The handle and corresponding ratchet mechanism secure the rod against the work piece. Further tightening engagement of the work piece is accomplished via a lever located on a top portion of the rod.

24 Claims, 10 Drawing Sheets

U.S. PATENT DOCUMENTS 6,354,580 B1 3/2002 Nagai
6,367,787 B1 * 4/2002 Poole et al. ..... 269/6
6,474,632 B1 * 11/2002 Liou ..... 269/6
7,036,807 B1 * 5/2006 Gasparyan et al. ..... 269/181
2007/0138724 A1 6/2007 Gibbons
2008/0136077 A1 * 6/2008 Yang ..... 269/6

* cited by examiner

RATCHETING C-CLAMP

REFERENCE TO PRIORITY DOCUMENT

This application claims priority of co-pending U.S. Provisional Patent Application Ser. No. 60/948,897 filed on Jul. 10, 2007. The disclosure of the Provisional Patent Application is hereby incorporated by reference in its entirety.

BACKGROUND

The present invention generally relates to a ratcheting C-clamp. More particularly, the present invention relates to a one-handed bidirectional ratcheting C-clamp capable of tightening a work piece via the ratchet mechanism and a lever and corresponding screw mechanism.

C-clamps are generally known in the art. A conventional C-clamp typically includes a "C" shaped member constructed from cast iron or another hard metal alloy material. One end of the C-shaped member has a threadable hole therein configured to receive a corresponding threaded rod. The rod is screwed through the hole toward an opposite end of a C-shaped member having a corresponding flat surface. The forward motion of the threaded rod is governed by the thread-by-thread screwing mechanism and is typically slow. The distance the rod moves with each turn is limited to the pitch of the screw threads. Faster movement is accomplished by incorporating a nut or other structure that enables only partial threading of the rod. Other mechanisms may allow the rod to completely disengage the threaded C-shaped member for axial movement therein. Accordingly, the flat end of the rod mates with the flat surface of the opposite end of the C-shaped member. Adjustment of the rod in this C-clamp is only accomplished by screwing the rod.

C-clamps are used in industry to secure a work piece or to secure several work pieces together. The work piece is placed between the flat end of the rod and the flat surface of the opposite end of the C-shaped member. The work piece is secured therebetween as the rod is screwed towards the flat surface of the C-shaped member. This squeezing or clamping action prevents movement of the work piece or prevents movement of several work pieces relative to one another. The C-clamp may include a pressure pad or vice jaw to further retain the work piece or the plurality of work pieces.

A common issue with known C-clamps is that the operation requires two hands. One hand holds the C-clamp assembly while the other hand turns a lever mounted to one end of the rod. The lever provides a higher mechanical advantage for screwing the rod through the hole end of the C-clamp. The lever allows the operator to obtain the necessary torque required to securely squeeze the work piece between the flat ends of the C-shaped member and the rod. Thus, a third hand or other retaining device is needed to assist the operator in order to hold the work piece in a steady position so that the operator may close the C-clamp therearound. Improvisations such as using a knee, a jury rig lever temporary welded to a work table, etc. are inadequate substitutes for the third hand. Such improvisations are also hazardous, time consuming and poor substitutes for other methods of holding the work piece in place. An alternative to using a third hand (necessarily requiring incorporation of a second person) is the use of an additional holding or retaining structure employed to clamp or retain the work piece prior to C-clamp application.

A one-hand operated C-clamp known in the art provides a mounted rack-held movable jaw that drops down against a work piece. The movable jaw is operated by gravity. The C-clamp further includes a cam-operated pawl that engages the rack via a hand-squeeze handle. The handle is used to increase the clamping pressure of the jaw against the bottom portion of the C-clamp. The C-clamp is locked into position with one stroke of the hand-squeeze handle. A lever in the jaw head rotates the jaw to obtain proper holding pressure when the clamping movement is insufficient. The C-clamp requires operating the lever with one hand while simultaneously holding the work piece with a second hand. Such a C-clamp is typically mounted to a table or other fixture. A disadvantage of such a C-clamp is that operators are unable to move the C-clamp into confined or narrow spaces where clamping may be desired.

SUMMARY

In view of the foregoing, there is a need for a C-clamp that is capable of tensioning a work piece or plurality of work pieces without the need of a third hand or other retaining device. Accordingly, the C-clamp frees the second hand to position or hold the work piece in place until firmly secured by the C-clamp. Such a C-clamp incorporates a spring actuated handle coupled to a ratchet mechanism that operates a rack and pinion gear mechanism for tensioning the rod portion of the C-clamp around the work piece. The C-clamp should further include a lever for screwingly tightening the C-clamp when further tensioning of the ratcheting mechanism is no longer obtainable. The C-clamp should also include a release mechanism to provide quick axial movement of the rod within one end of the C-shaped member. Moreover, such a C-clamp should be lightweight in construction, mobile, and capable of exerting sufficient force to properly tension a work piece within the clamp to prevent movement thereof. The C-clamp should also be relatively simply constructed to reduce the cost of manufacturing and simplify use and maintenance.

A ratcheting C-clamp is herein provided. The C-clamp of the present invention includes a spring loaded handle that operates the clamping mechanism with only one hand. The spring loaded handle is coupled to a ratchet mechanism threadingly engaged to the threads of a corresponding rod. Accordingly, the ratchet mechanism is bidirectional to allow an operator to elevate or descend the corresponding rod within a gap formed by the top and bottom portions of the C-shaped C-clamp. A lever integral to the rod provides an additional work piece tightening mechanism. When the ratcheting mechanism is no longer feasible, an operator may further screwingly tighten the rod via the lever. Moreover, an additional release button incorporated into the ratcheting mechanism disengages the ratchet pawl to facilitate free axial movement of the rod without interference or operation of the ratchet mechanism or the lever and corresponding screw.

The C-clamp of the present invention is operated by compressing a spring loaded handle toward the body portion of the C-clamp. The front end of the handle is mechanically coupled to one end of a ratchet mechanism. Movement of the handle causes simultaneous movement in the ratchet mechanism. Such movement operates the ratchet. Accordingly, the ratchet moves a set of teeth engaged to the threads of a corresponding rod. Counter-clockwise movement elevates the rod, while clockwise movement descends the rod within the gap formed between each side of the C-shaped C-clamp. The ratchet gears and rod threads engage to form a simple screw mechanism. Hence, an operator is able to properly locate a work piece between each side of the C-shaped member of the C-clamp while simultaneously tightening the rod around the work piece via the handle and ratchet mechanism. Once the rod is sufficiently tightened against the work piece such that the ratchet mechanism is no longer feasible for operation, the lever located on the top portion of the rod is further operable to further tighten the rod against the corresponding work piece. A button mounted in the side portion of the C-clamp disengages the pawl from the ratchet mechanism to facilitate axial movement of the rod without the need to use the ratchet mechanism or lever and screw.

In one aspect, there is disclosed an adjustable C-clamp, comprising: a main body; a threaded rod movably attached to main body; an actuator; a ratchet mechanism that mechanically couples the rod to the actuator, wherein actuation of the actuator drives the ratchet mechanism to cause axial movement of the rod toward or away from a workpiece; and a gear assembly connecting the ratchet mechanism to the rod.

In another aspect, there is disclosed an adjustable C-clamp, comprising: a main body; a threaded rod movably attached to main body; an actuator; and a ratchet mechanism that mechanically couples the rod to the actuator, wherein actuation of the actuator drives the ratchet mechanism to cause axial movement of the rod toward or away from a workpiece.

In another aspect, there is disclosed an adjustable C-clamp, comprising: a main body; a threaded rod movably attached to main body; an actuator; a ratchet mechanism that mechanically couples the rod to the actuator, wherein actuation of the actuator drives the ratchet mechanism to cause axial movement of the rod toward or away from a workpiece; and a quick-release member, wherein actuation of the quick-release member causes the ratchet mechanism to uncouple from the rod so that the rod can move freely toward or away from the workpiece.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION

Figure 1:
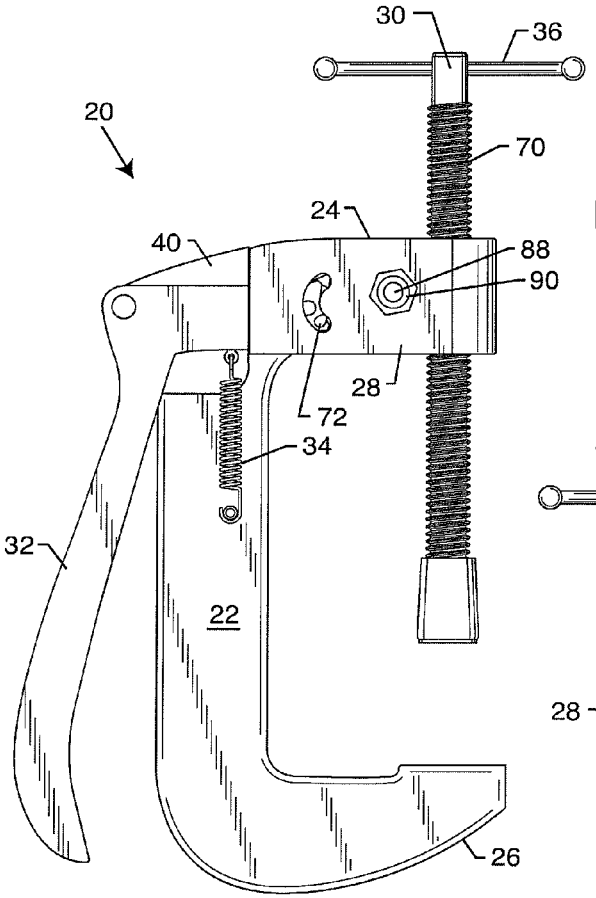
FIG. 1 is a side view of a C-clamp of the present invention.

As shown in the exemplary drawings for purposes of illustration, the present disclosure for a ratcheting C-clamp is generally referenced by the reference numeral 20. Turning now to the representative figures in the specification, FIG. 1 illustrates a side view of the C-clamp 20 of the present disclosure. The C-clamp 20 includes a conventional C-shaped member 22 preferably manufactured from cast iron or another hard metal alloy material. The C-shaped member 22 further includes a top section 24 and a bottom section 26 that are utilized with the other components of the present invention to appropriately retain a work piece (not shown) in the gap therebetween. The top section 24 in FIG. 1 generally illustrates a cover 28 that houses the ratcheting mechanism used to move a threaded rod 30 axially as generally shown in FIGS. 6-9. The C-clamp 20 of the present invention further includes a handle 32 coupled to the ratcheting mechanism and retained in tension by a spring 34. The spring 34 is preferably a tension spring. As will be described more fully herein, the rod 30 may be moved axially within the top section 24 of the C-shaped member 22 via the handle 32, a lever 36 or a disengagement button 38 (FIG. 2).

Figure 2:
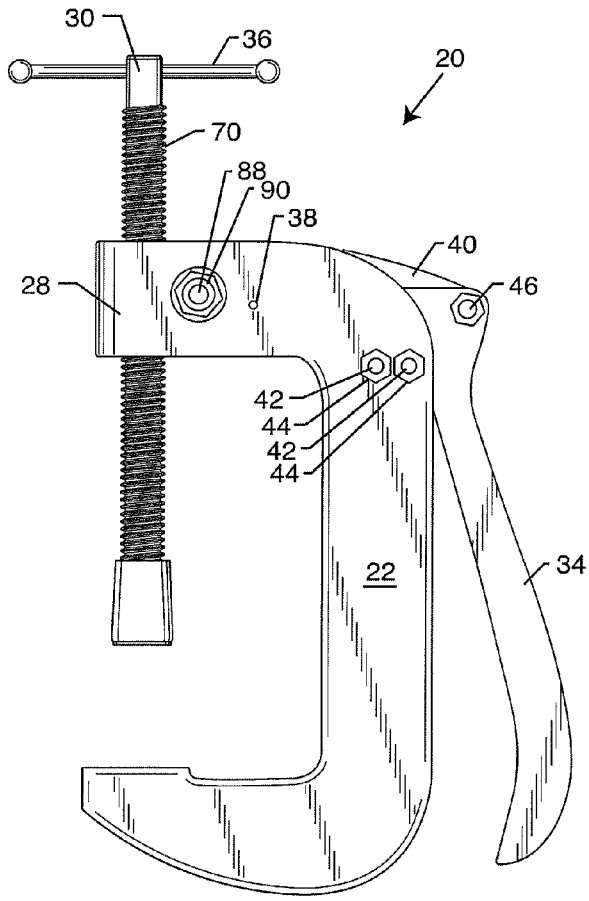
FIG. 2 is a side view of the backside of the C-clamp of FIG. 1.

FIG. 2 illustrates the backside of the C-clamp 20 of the present invention. The handle 32 mounts to the C-shaped member 22 via a mount plate 40 (FIGS. 1 and 2). The mount plate 40 is secured to the C-shaped member 22 via a pair of screws 42 and a pair of corresponding nuts 44. The mount plate 40 may engage the C-shaped member 22 via any other method known in the art, including welding, other mechanical means, or adhesion. The mount plate 40 must be able to withstand the torque exerted at a handle pivot 46 when operating the handle 32 in accordance with the present invention. The cover 28 shields the corresponding backside of the ratchet mechanism as is shown in more detail in FIG. 5.

Figure 3:
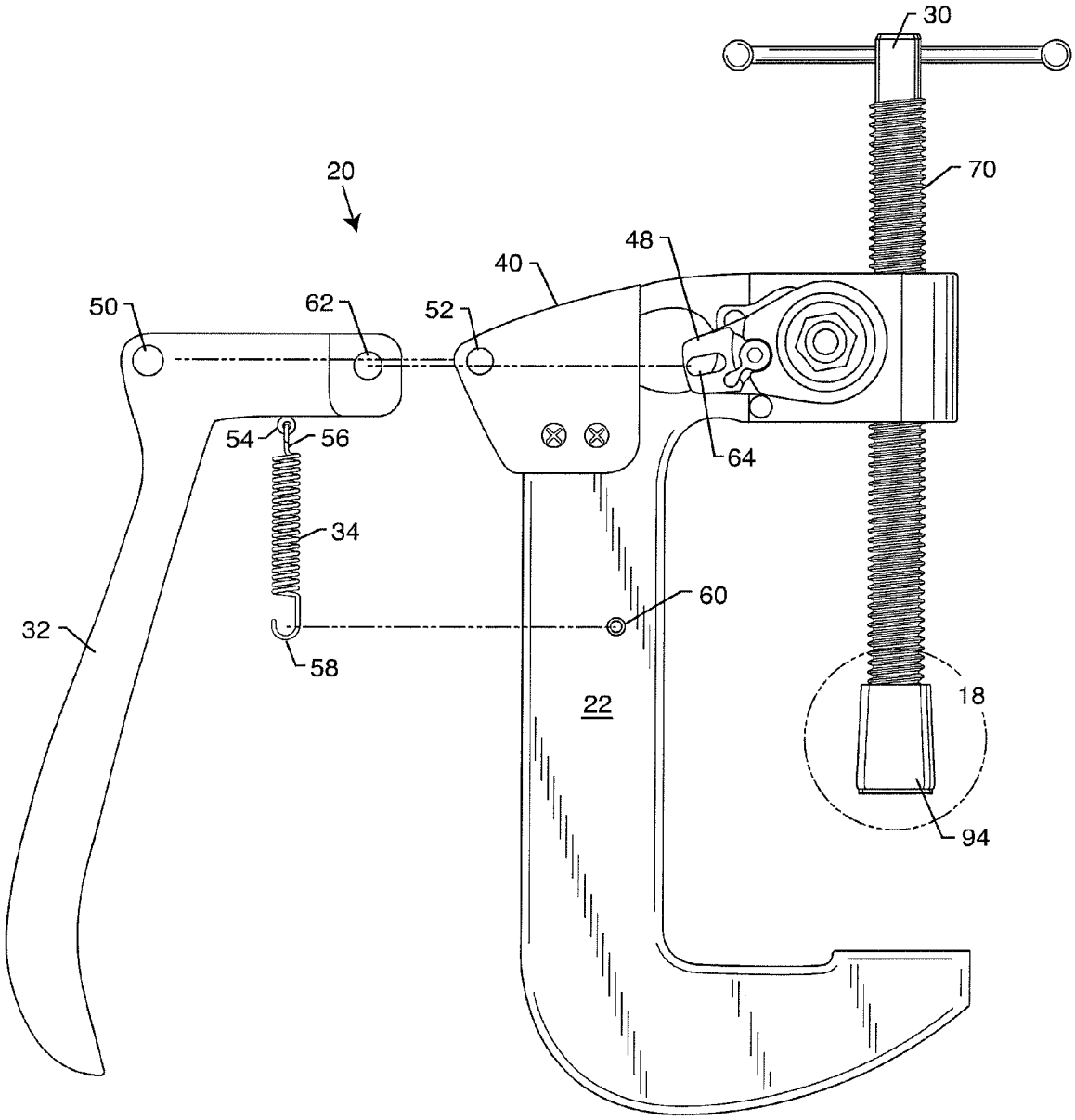
FIG. 3 is an exploded side view of a C-clamp, illustrating attachment of a handle and ratchet mechanism to a C-shaped member.

FIG. 3 illustrates an exploded view of the C-clamp 20 of the present invention additionally detailing the ratchet mechanism as shielded by the cover 28 in FIG. 1. FIG. 3 illustrates the handle 32 removed from the C-shaped member 22, the mount plate 40 and a ratchet body 48. The handle 32 is secured to the mount plate 40 via a handle aperture 50 and a mount plate aperture 52. A nut and bolt combination may be used to retain the handle 32 relative to the mount plate 40 about the handle aperture 50 and the mount plate aperture 52. The important aspect is that the securement of the handle 32 relative to the mount plate 40 allows the handle 32 to rotate relative to the mount plate 40, about the handle pivot 46 integral therein. The handle pivot 46 is concentric to the handle aperture 50 and the mount plate aperture 52.

The handle 32 is retained in a tensioned position by the spring 34. Preferably, the spring 34 is a tension spring or other material or mechanical device that is capable of maintaining the handle 32 in the position generally shown in FIG. 4. The spring 34 is attached to the handle 32 via a loop 54. Loop 54 is preferably made from a similar hardened steel or other comparable material. The loop 54 may be welded to the handle 32 or formed integral therein from the same metal stock as the handle 32. The loop 54 must be strong enough to withstand the axial forces exerted by the spring 34. The spring 34 includes a top hook 56 that engages the loop 54 as generally shown in FIG. 3. A bottom hook 58 connects to a post 60 secured to the C-shaped member 22 by welding or the like. The bottom hook 58 is secured in a manner generally shown in FIGS. 6-9. The bottom hook 58 may also clip into the post 60. Alternatively, the bottom hook 58 may attach to the C-shaped member 22 via a loop, similar to loop 54 and the top hook 56. Although the spring 34 may attach to the C-shaped member 22 by any other method known in the art to retain a spring relative to movable members. In this regard, the spring 34 is pivotal to the movement of the handle 32 and the ratchet body 48 relative to the mount plate 40. Preferably, the surface between the handle 32 and the mount plate 40 includes some form of grease or other lubricant to reduce any friction thereof.

The handle 32 is coupled to the ratchet mechanism via a ratchet aperture 62 and a corresponding slot 64 formed in the ratchet body 48. A pin 66 (FIG. 4) is retained concentrically within the ratchet aperture 62 and is configured to slide within the slot 64. Movement of the pin 66 within the slot 64 is described in more detail below. It is the movement of the handle 32 engaged with the ratchet body 48, relative to the C-shaped member 22 that provides one method of axial movement of the rod 30.

Figure 4:
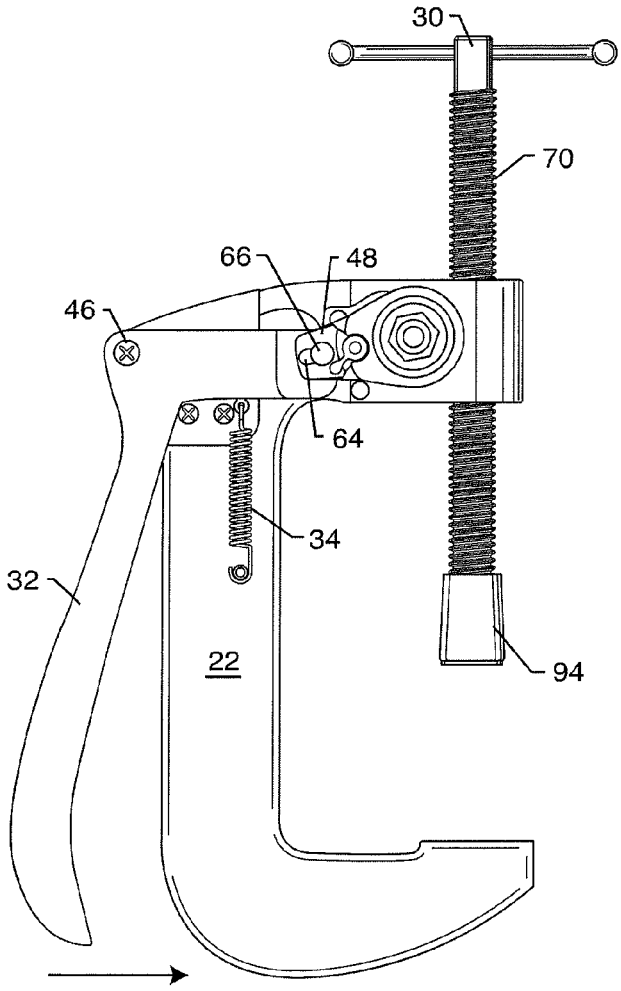
FIG. 4 is a side view of the C-clamp in FIG. 1, illustrating the internal ratchet mechanism.
Figure 5:
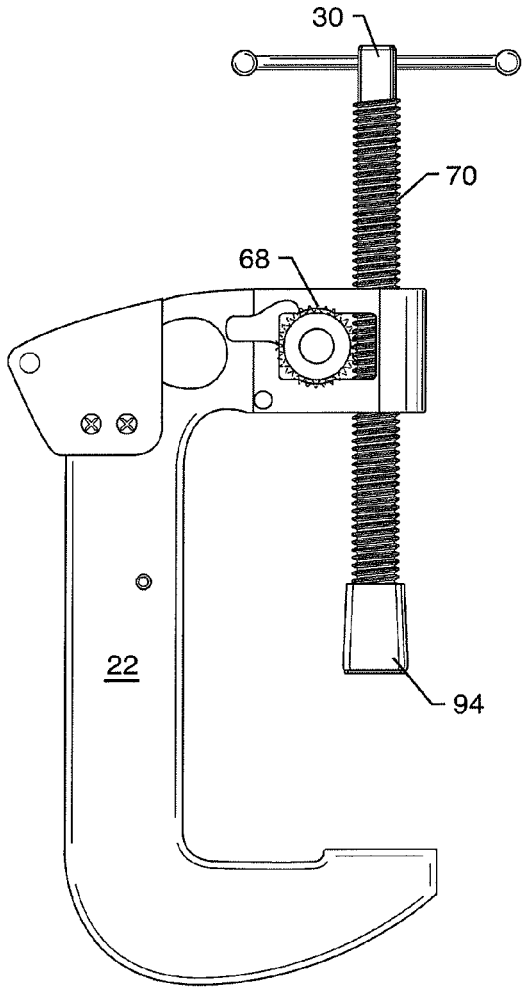
FIG. 5 is a side view of the C-clamp of FIG. 2, illustrating engagement of the ratchet mechanism with the threads of a rod.

FIG. 4 further illustrates the handle 32 coupled to the ratchet body 48 via the pin 66 in the slot 64. Operation of the handle 32 generally involves squeezing the handle 32 toward the C-shaped member 22, along the arrow shown in FIG. 4. The handle 32 is further tensioned by the spring 34 when moved along this directional arrow. Squeezing the handle 32 relative to the C-shaped member 22 is accomplishable with one hand. In effect, the handle 32 rotates about the handle pivot 46 thereby exerting a force on the pin 66 that causes the ratchet body 48 to rotate counter-clockwise. Such rotation causes the spring 34 to stretch. Thereby, the spring 34 exerts an axial force on the loop 54 that would otherwise cause the handle 32 to return to the position as shown in FIG. 4, absent the squeezing force exerted by a user. FIG. 5 illustrates a backside view of the C-shaped member 22 wherein the ratchet mechanism includes a set of gear teeth 68 that engage a set of threads 70 integral to the rod 30. Engagement of the gear teeth 68 with the threads 70 provides two methods for moving the rod 30 axially, as generally shown in FIGS. 6-9.

Figure 6:
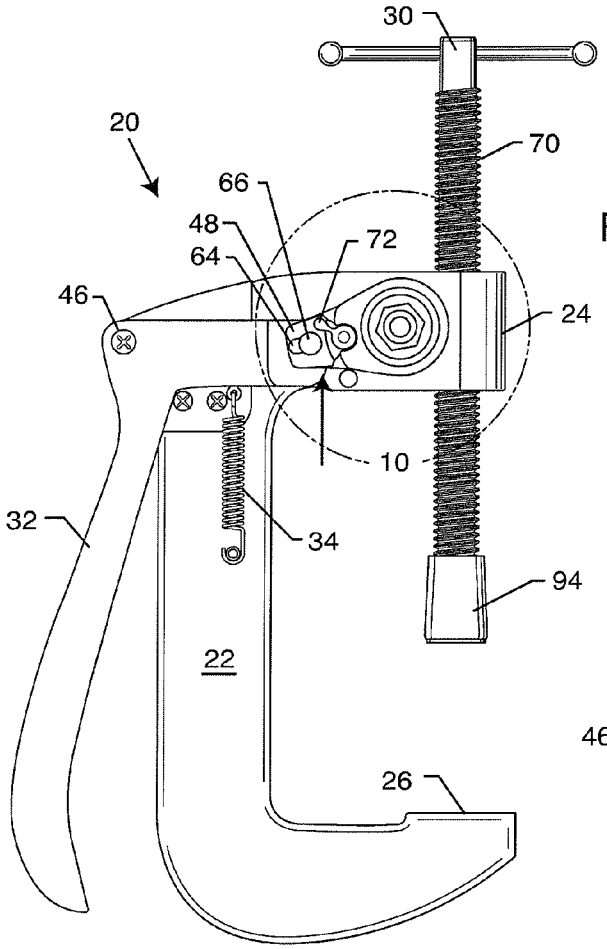
FIG. 6 is a side view of a C-clamp, illustrating downward engagement of the ratchet mechanism.
Figure 7:
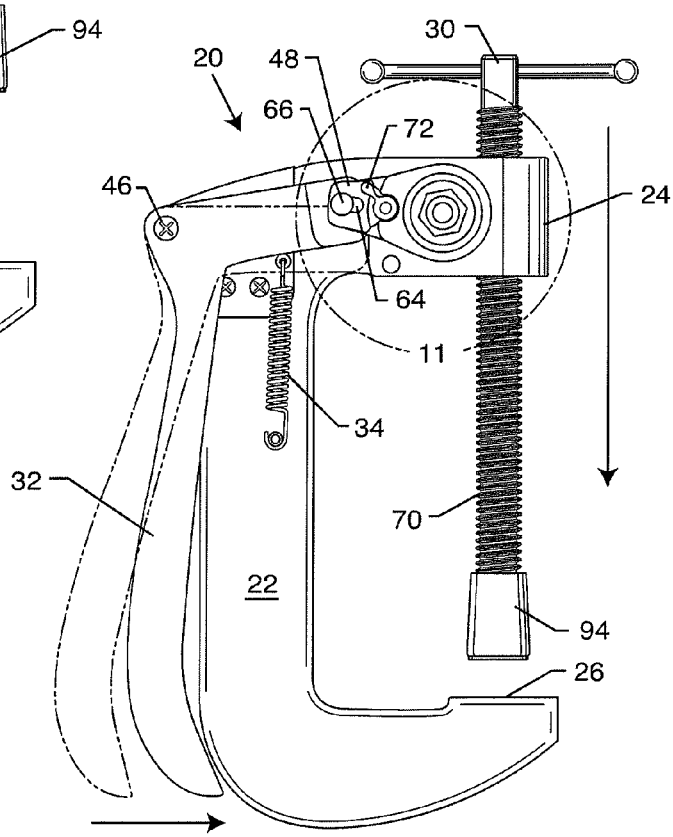
FIG. 7 illustrates descending movement of the rod within the gap formed within the C-shaped member.
Figure 8:
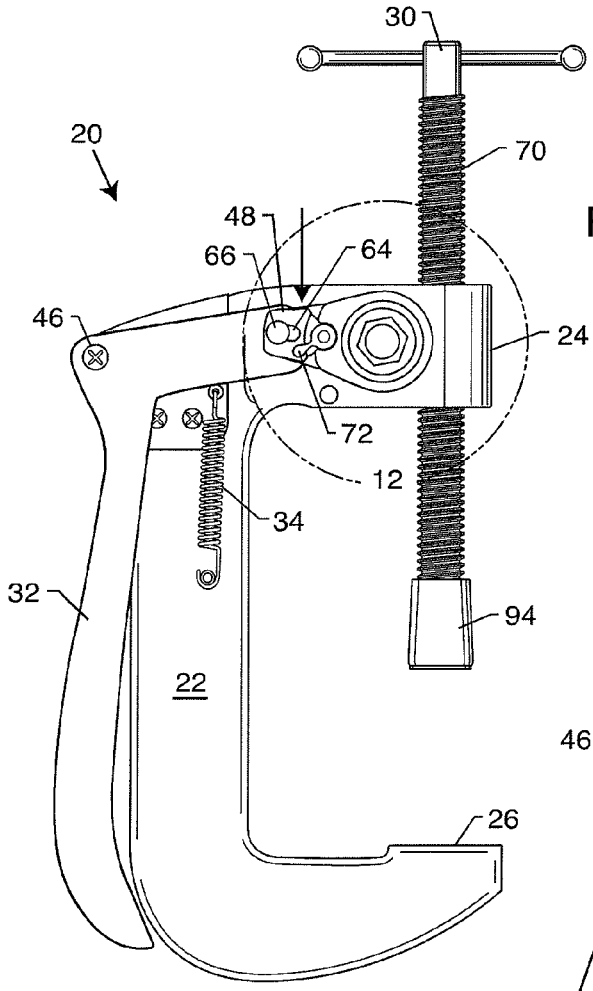
FIG. 8 is a side view of a C-clamp, illustrating upward engagement of the ratchet mechanism.
Figure 9:
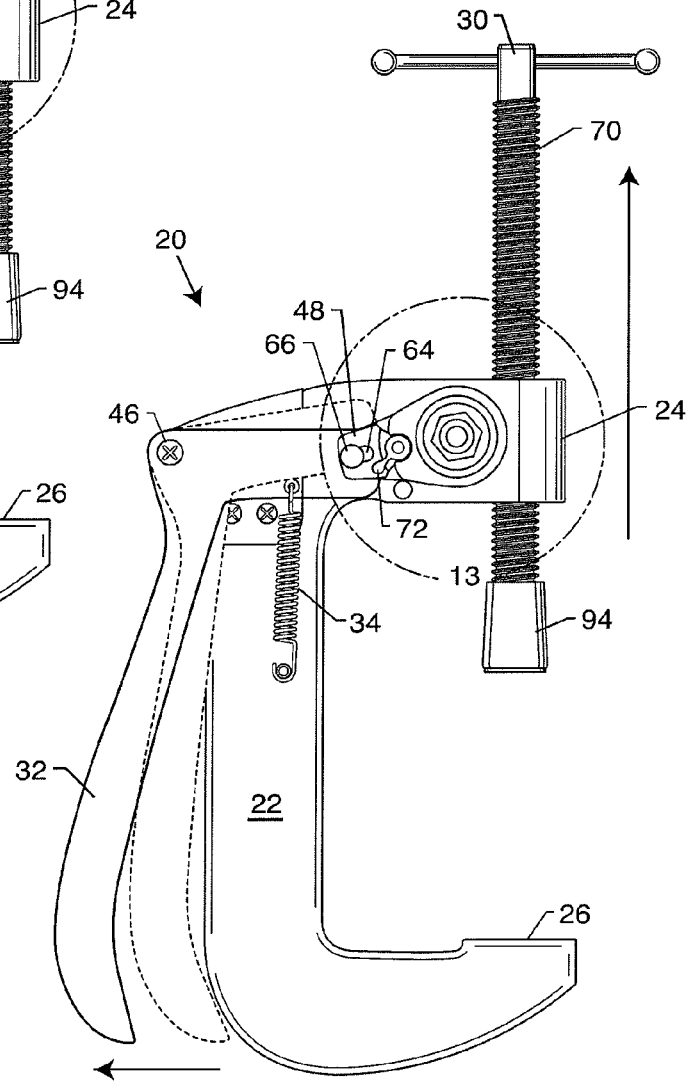
FIG. 9 illustrates ascending movement of the rod within the gap formed within the C-shaped member.
Figure 10:
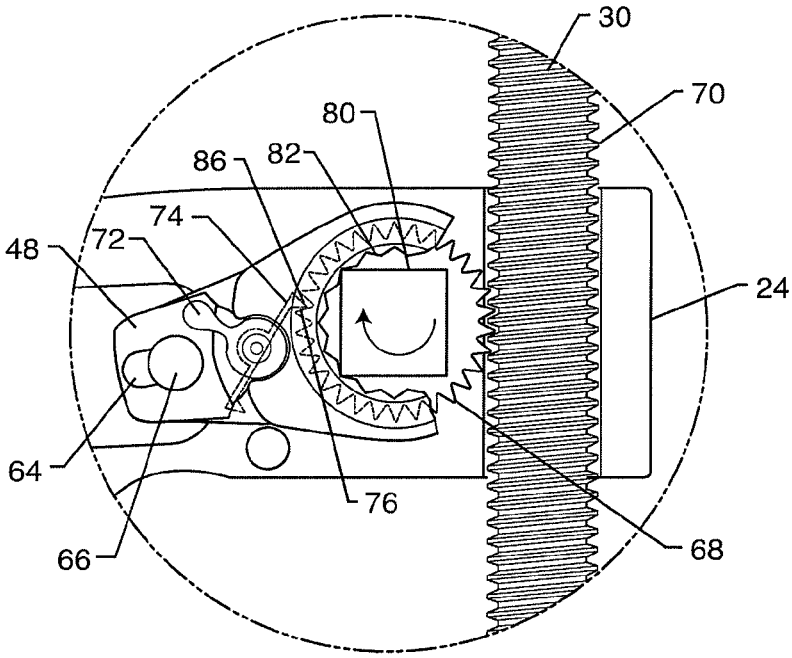
FIG. 10 is an enlarged view of the ratchet mechanism of FIG. 6, taken about the line 10.
Figure 15:
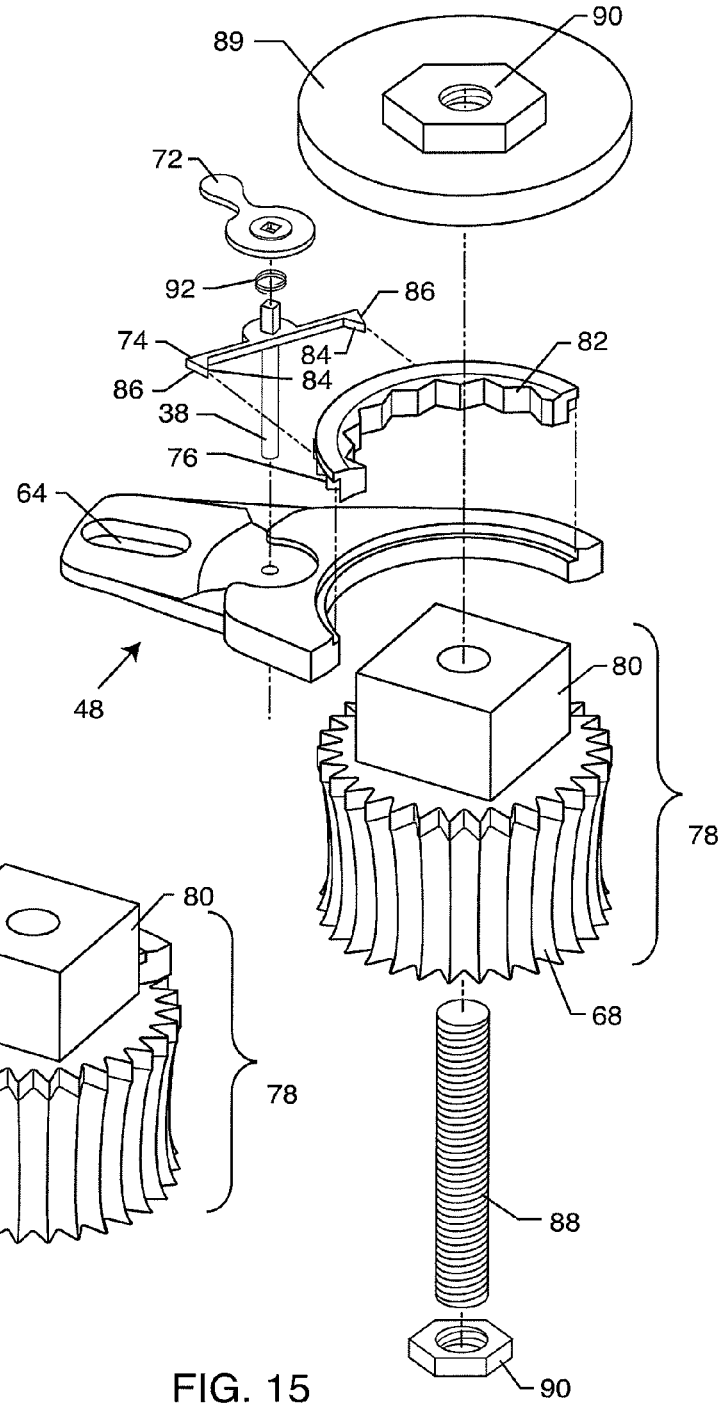
FIG. 15 is an exploded perspective view further illustrating the components of the ratchet mechanism and the gear coupler.

FIGS. 6-9 illustrate axial movement of the rod 30 within the top section 24 of the C-shaped member 22. FIGS. 6 and 7 illustrate descending movement of the rod 30, while FIGS. 8 and 9 illustrate ascending movement of the rod 30. In FIG. 6, a pawl arm 72 is moved upwardly to engage a pawl 74 with any one of a set of ratchet teeth 76 (FIG. 10). The pawl arm 72 is generally accessible for fingertip engagement through the cover 28 as shown in FIG. 1. In the position shown in FIGS. 6 and 10, the pawl arm 72 is coupled to the pawl 74 that engages the ratchet teeth 76 with abutting surfaces. As the handle 32 moves from the phantom position (to a compressed position) in FIG. 7, the engagement of the pawl 74 with the ratchet teeth 76 rotates the ratchet mechanism clockwise, as the arrow generally shows in FIGS. 10-11. The ratchet body 48 then slips back into position relative to a gear coupler 78 (FIG. 15), as is more fully described below. The gear coupler 78 includes the gear teeth 68 and a block coupler 80. The block coupler 80 is preferably shaped as some form of polygon. As best shown in FIG. 15, the block coupler 80 is coupled to the ratchet mechanism via a ratchet coupler 82. As shown best in the top views of FIGS. 10-11, the block coupler 80 fits snugly within the indentations of the ratchet coupler 82. Accordingly, the block coupler 80 could be any form of polygon that matches the indentations formed as part of the ratchet coupler 82. In the embodiment shown in FIGS. 10-13, the block coupler 80 includes fewer sides than the corresponding indentations of the ratchet coupler 82. The block coupler 80 may include a set of sides that correspond to the number of indentations in the ratchet coupler 82. The block coupler 80 should not have more sides. The important aspect of this coupling is that as the handle 32 moves from an initial position to a compressed position, the pawl arm 72 engages the ratchet teeth 76 which, in turn, rotates the ratchet coupler 82 as engaged with the block coupler 80. The block coupler 80 is then rotated as generally shown from FIG. 10 to FIG. 11. Accordingly, the gear teeth 68 rotate as the block coupler 80 rotates. Rotation of the gear teeth 68 also causes rotation of the threads 70 of the threaded rod 30 as the gear teeth 68 are coupled thereto. Rotation of the threads 70 causes the rod 30 to either move upward or downward depending on the movement of the threading coupled thereto. The rotation of the gear coupler 78 as noted in FIGS. 10-11 causes the corresponding engaged threads 70 to rotate the rod 30 downwardly. Hence, as the handle 32 in FIG. 7 is pushed inwardly, as noted by the directional arrow, the corresponding rod 30 descends in the gap formed between the top section 24 and the bottom section 26 of the C-shaped member 22.

Figure 12:
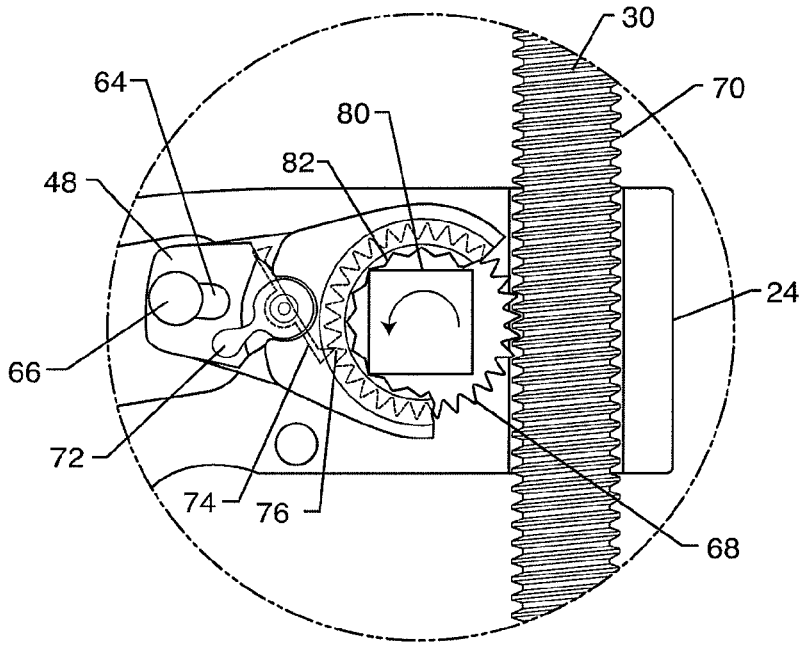
FIG. 12 is an enlarged view of the ratchet mechanism in FIG. 8, taken about the line 12.
Figure 13:
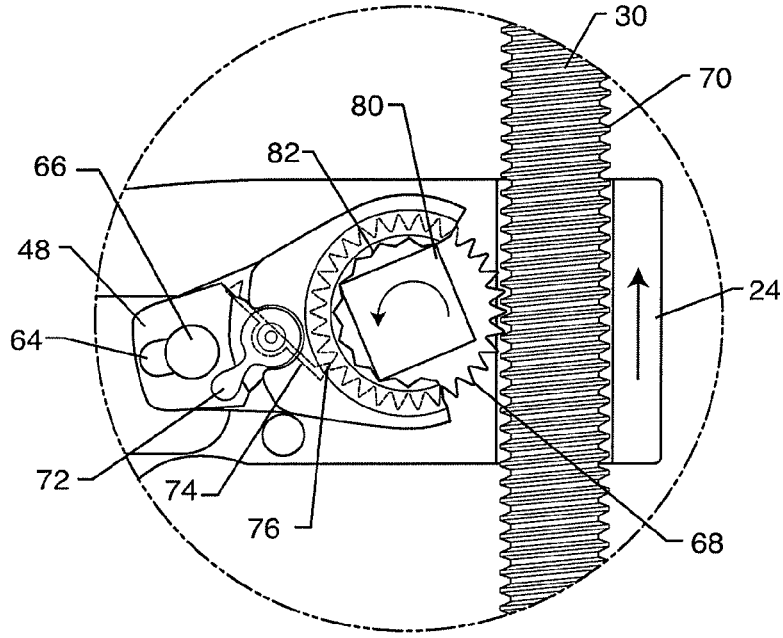
FIG. 13 is an enlarged view of the ratchet mechanism in FIG. 9, taken about the line 13, further illustrating ascending movement of the rod relative to the ratchet mechanism.

Alternatively, the bidirectional ratcheting mechanism of the present invention allows an operator to ascend the rod 30 from within the gap formed between the top section 24 and the bottom section 26 of the C-shaped member 22. Like the descending operation, ascending operation of the C-clamp 20 of the present invention is also feasible one-handed. As shown in FIG. 8, the pawl arm 72 is rotated downwardly as noted by the directional arrow. Accordingly, the pawl 74 engages the ratchet teeth 76 as shown in FIGS. 12-13, and opposite FIGS. 10-11. As depicted in FIGS. 10-13, the pawl 74 has a pair of teeth having a set of sloped inner edges 84 and a set of blocked outer edges 86 (best shown in FIG. 15). In the embodiment of FIG. 12, the handle 32 is initially compressed or squeezed against the C-shaped member 22 by the user. Rotation of the pawl 74 according to the previously described motion, allows the sloped inner edges 84 to slip over the ratchet teeth 76. Accordingly, the ratchet coupler 82 and corresponding gear coupler 78 do not rotate. Release of the handle 32, as generally shown by the directional arrow in FIG. 9, rotates the handle 32 about the handle pivot 46 such that the pin 66 slides through the slot 64 allowing the ratchet body 48 and the handle 32 to return to the initial position shown in FIG. 1. As more specifically shown in FIG. 13, the outer edge 86 of the pawl 74 abuts a corresponding ratchet tooth 76 such that rotation of the ratchet body 48 causes counter-clockwise movement of the ratchet coupler 82, the engaged block coupler 80 and the corresponding gear teeth 68. Engagement of the gear teeth 68 with the threads 70 causes the rod 30 to ascend from within the gap formed between the top section 24 and the bottom section 26, as generally shown by the arrow in FIG. 13.

Figure 11:
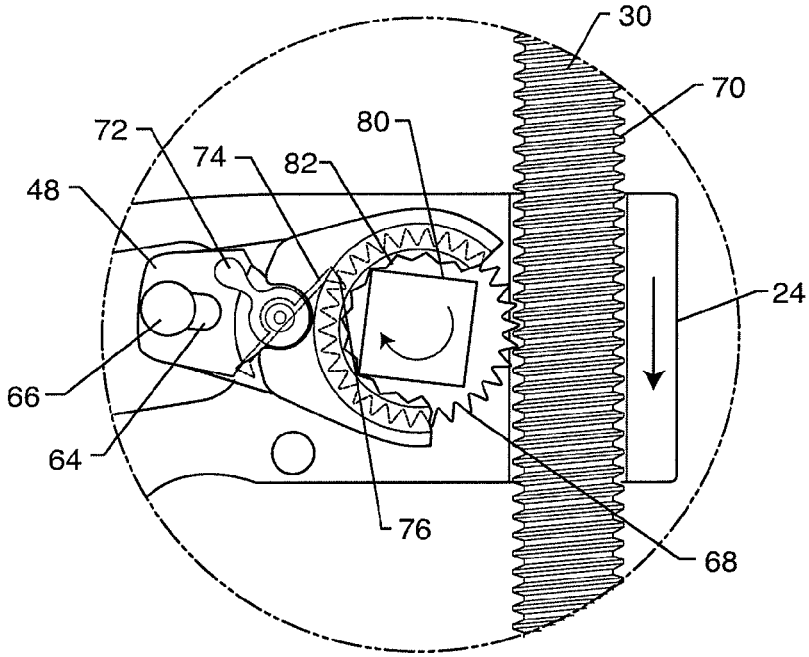
FIG. 11 is an enlarged view of the ratchet mechanism of FIG. 7, taken about the line 11, further illustrating descending movement of the rod relative to the ratchet mechanism.

The slipping of the pawl 74 relative to the ratchet teeth 76 also occurs when moving the rod 30 in the descending motion described in the embodiments of FIGS. 6-7 and corresponding FIGS. 10-11. As specifically shown in FIG. 10, the outer edge 86 of the pawl 74 abuts a corresponding ratchet tooth 76. The handle 32 is in the initial position of FIG. 10, as shown generally in FIG. 6. When the handle 32 is compressed, as shown from phantom in FIG. 7, the outer edge 86 of the pawl 74 remains abutted against the corresponding ratchet tooth 76. The ratchet body 48 and the gear coupler 78 rotate as previously described. Return of the handle 32 to the initial position in FIG. 6 allows the inner edge 84 to slip over the corresponding ratchet teeth 76. Accordingly, no rotation of the ratchet body 48 or gear coupler 78 occurs.

Figure 14:
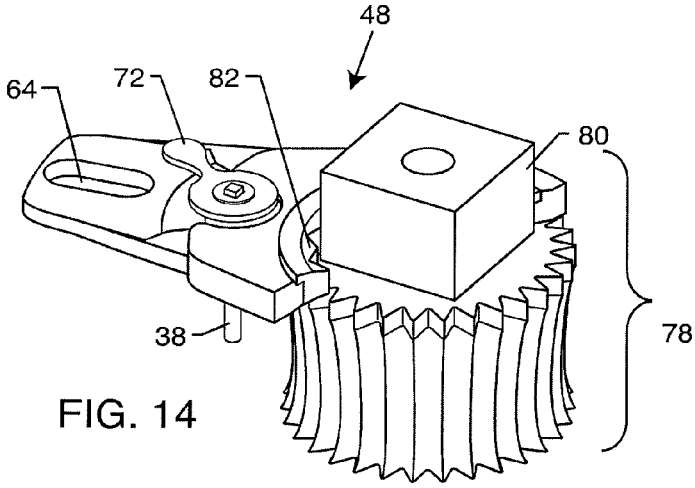
FIG. 14 is a perspective cut-out view of the ratchet mechanism and gear coupler of the present invention.

FIGS. 14-15 show an exploded perspective view of the ratchet body 48 and corresponding gear coupler 78. FIG. 14 illustrates the ratchet body 48 having the slot 66 formed at one end therein. The pawl arm 72 is coupled to the pawl 74 by key fit. In this embodiment, the pawl arm 72 and pawl 74 have key fitting square structures formed therein. Although, it is conceived that this key fit may encompass any one of a number of different shapes, sizes or configurations. The important aspect is that as the pawl arm 72 is rotated either upwardly or downwardly, as previously described, the corresponding pawl 74 is also rotated within the ratchet body 48 (compare FIGS. 10-11 with FIGS. 12-13).

As shown in FIG. 14, the block coupler 80 fits snuggly into the ratchet coupler 82. The ratchet coupler 82 has a plurality of ratchet teeth 76 disposed circumferentially around the exterior (best shown in FIG. 15) thereof for engagement with the pawl 74. The ratchet teeth 76 are generally hidden by the casing of the ratchet body 48. The gear coupler 78 is retained within the C-shaped member 22 via the concentrically located bolt 88, washer 89, and corresponding screws 90 (also shown in FIGS. 1-2). The screws 90 mount to the cover 28 as shown in FIGS. 1-2 and may be optionally used with corresponding washers (not shown).

Figure 16:
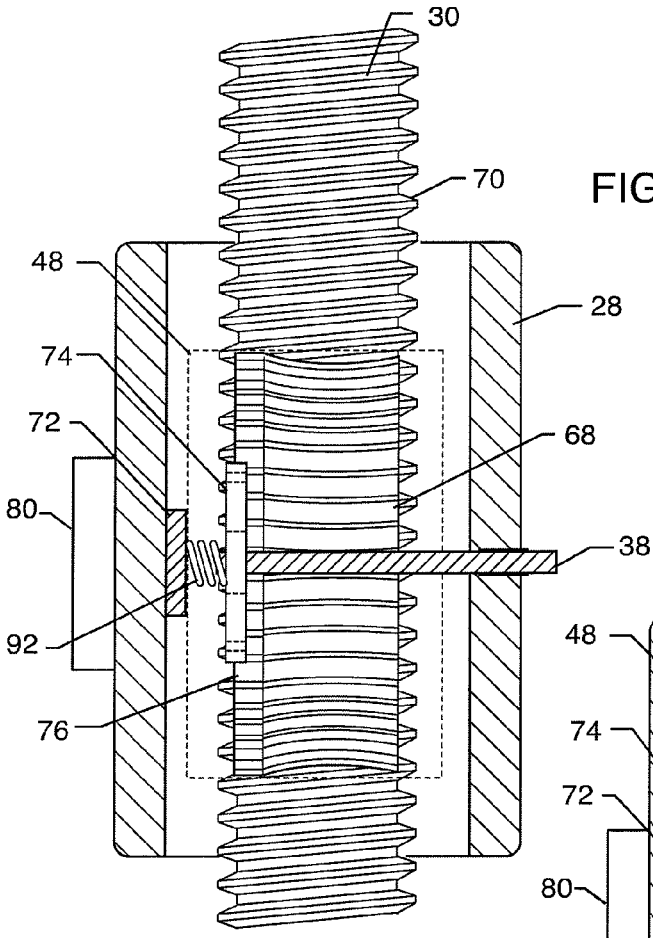
FIG. 16 is an end view of a C-clamp, illustrating pawl engagement within the ratchet mechanism.
Figure 17:
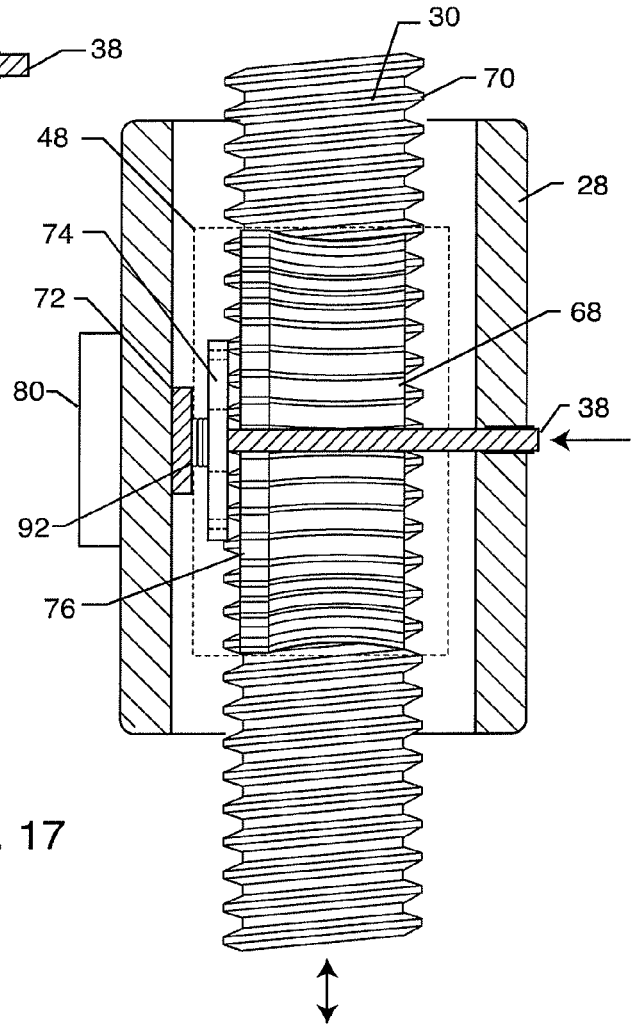
FIG. 17 is an alternate end view of FIG. 16, illustrating disengagement of the pawl from the ratchet mechanism.

Pawl 74 is also disengageable from the ratchet teeth 76 via the disengagement button 38. FIGS. 16-17 illustrate an end view of the C-clamp 20, and more specifically the ratchet body 48. The disengagement button 38 is depressed from an initial engaged position (FIG. 16) to a secondary disengaged position (FIG. 17). The pawl 74 is disengaged from the ratchet teeth 76 by depressing the disengagement button 38 along the arrow generally shown in FIG. 17. A button spring 92 (also shown in FIG. 15) is compressed against the corresponding pawl arm 72. The disengagement button 38 protrudes from the exterior of the cover 28 via an aperture therein (not shown). The disengagement button 38 is biased outwardly to protrude through the exterior of the cover 28 via the button spring 92. Depression of the disengagement button 38 causes the button spring 92 to be compressed against the pawl 74. Disengagement thereof of the pawl 74 from the ratchet teeth 76 allows the rod 30 to freely move axially within the top section 24 of the C-shaped member 22. The threads 70 of the rod 30 remain engaged with the gear teeth 68 of the gear coupler 78. Axial movement of the rod 30 accordingly causes rotation of the gear teeth 68, the corresponding block coupler 80, the ratchet coupler 82, and the ratchet teeth 76. The difference in this embodiment is that the ratchet teeth 76 do not engage or slip against the now disengaged pawl 74. Hence, the rod 30 may freely move axially within the top section 24 while the disengagement button 38 remains depressed. The rod 30 may ascend or descend within the gap formed between the top section 24 or the bottom section 26. Such disengagement of the pawl 74 from the ratchet teeth 76 allows for faster axial movement of the rod 30. Hence, the rod 30 is not limited to movement by the aforementioned ratcheting mechanism 48 or the pitch depth of the threads 70 of the rod 30, as screwingly threaded via the lever 36.

Moreover, the rod 30 may be tightened against a work piece, or correspondingly released from a work piece, by rotating the lever 36 (FIGS. 1-2) either clockwise or counterclockwise. Clockwise rotation rotates the threads 70 through the corresponding gear teeth 68 in order to descend the rod 30 through the top section 24. The lever 36 is capable of supplying an additional 150 lbs. of hand pressure as a supplemental securement mechanism. The lever 36 provides a higher mechanical advantage relative to the handle 32 and corresponding ratchet mechanism. Such additional pressure further enables securement of a work piece within the gap formed in the C-shaped member 22. Oppositely, counterclockwise rotation of the threads 70 causes the rod 30 to ascend in the top section 24 via threading engagement with the gear teeth 68 of the gear coupler 78. Such movement is independent of the ratchet mechanism or the disengagement button 38 as previously described. Rotation depth and speed is limited to the pitch depth of the threads 70 formed on the threaded rod 30.

Figure 18:
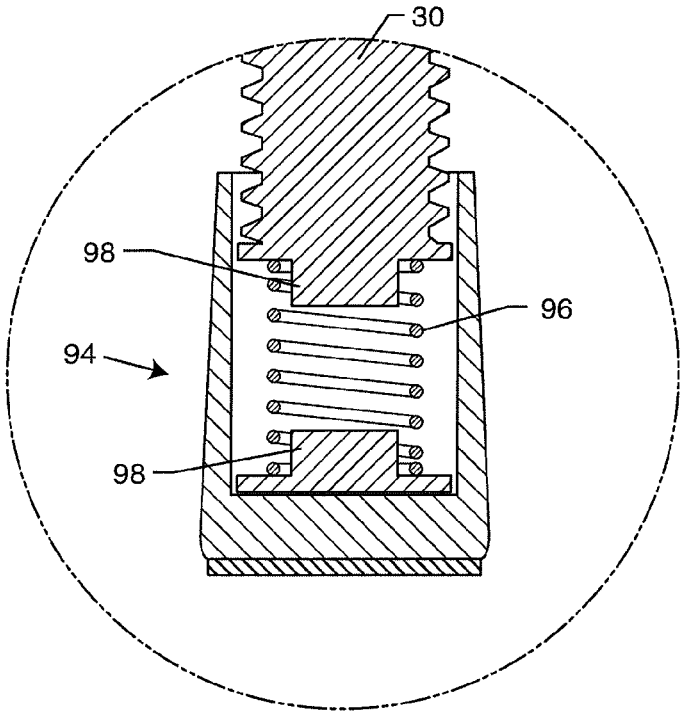
FIG. 18 is an enlarged view of a plunger in FIG. 3, taken about the line 18, further illustrating a compression spring located therein.
Figure 19:
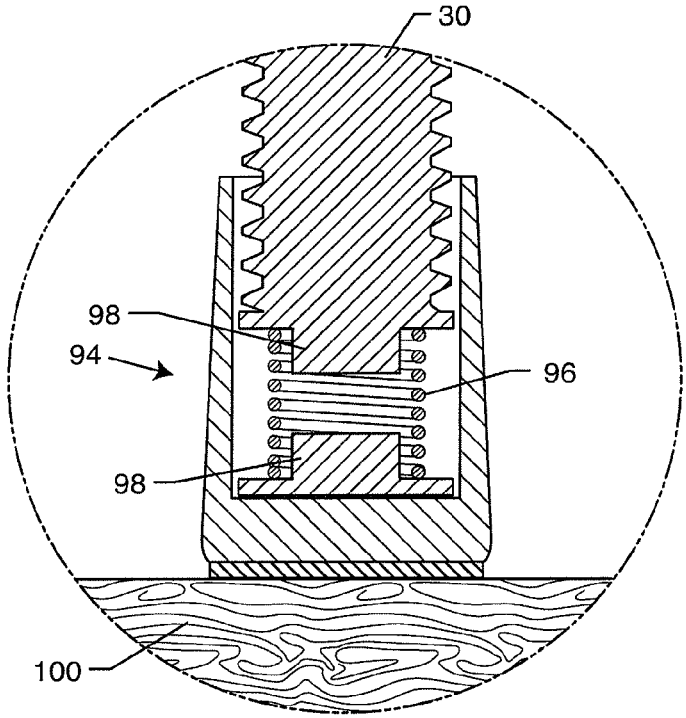
FIG. 19 is an alternative view of FIG. 18, illustrating compression of the spring within the plunger.

FIGS. 18-19 illustrate an enlarged plunger 94, generally shown in FIG. 3. The plunger 94 is mounted to one end of the rod 30 and incorporates a kickback spring 96. The spring 96 is located concentrically within the plunger 94 by slipping over the pair of location blocks 98. The spring 96 is in an initial position in FIG. 18. Preferably the spring 96 is a 100 lb. spring that absorbs pressure and backlash when the plunger 94 is securely depressed against a work piece 100, as generally shown in FIG. 19. The axial travel distance of the spring 96 is preferably limited to approximately 0.0030 of an inch. Once the rod 30 no longer retains the work piece 100 within the C-shaped member 22, the spring 96 returns to the initial position as shown in FIG. 18.

One advantage of the present invention is the C-clamp 20 is configured for one-handed operation. A user is able to operate the C-clamp 20 by gripping the handle 32 and corresponding C-shaped member 22 with one hand. The spring 34 is tensioned such that the user may easily squeeze the handle 32 toward the C-shaped member 22 as previously described. Accordingly, the user may position a work piece or a plurality of work pieces within the gap formed between the top section 24 and the bottom section 26 of the C-shaped member 22 for securement within in the C-clamp 20. Users are able to both tighten and loosen the work piece via the one-handed operation detailed above.

Although several embodiments have been disclosed in detail for purposes of illustration, various modifications may be made without departing from the scope and spirit of the invention.

The invention claimed is:

1. An adjustable C-clamp, comprising:

a main body;

a threaded rod movably attached to main body;

an actuator;

a ratchet mechanism that mechanically couples the rod to the actuator, wherein actuation of the actuator drives the ratchet mechanism to cause axial movement of the rod toward or away from a workpiece; and a gear assembly connecting the ratchet mechanism to the rod, wherein the gear assembly includes external pear teeth that couple to external threads on the rod.

2. A C-clamp as in claim 1, wherein the main body is c-shaped.

3. A C-clamp as in claim 1, wherein the actuator is a handle.

4. A C-clamp as in claim 3, wherein the handle is pivotably attached to main body.

5. A C-clamp as in claim 4, further comprising a spring attached to the handle and the main body, wherein the spring maintains handle in state of tension having a default position away from main body.

6. A C-clamp as in claim 1, wherein the actuator comprises a handle and wherein actuation of the actuator comprises squeezing the handle toward the main body.

7. A C-clamp as in claim 1, wherein the actuator can be actuated using a single hand.

8. A C-clamp as in claim 1, wherein the ratchet mechanism includes ratchet teeth that indirectly couple to threads on the rod.

9. A C-clamp as in claim 8, wherein the ratchet teeth couple to the gear assembly.

10. A C-clamp as in claim 1, wherein the ratchet mechanism includes a pawl arm and a pawl, wherein the pawl arm is movable between two positions including a first position that causes clockwise movement of ratchet mechanism, and a second position that causes counterclockwise movement of ratchet mechanism.

11. A C-clamp as in claim 10, wherein the actuator comprises a handle and wherein movement of the handle toward main body when the pawl arm is in the first position causes the rod to move toward the workpiece.

12. A C-clamp as in claim 10, wherein the actuator comprises a handle and wherein movement of the handle toward the main body when the pawl arm is in the first position causes the rod to move away from the workpiece.

13. A C-clamp as in claim 1, further comprising a quick-release member, wherein actuation of the quick-release member causes the ratchet mechanism to uncouple from the rod so that the rod can move freely toward or away from the workpiece.

14. A C-clamp as in claim 1, further comprising a quick-release member, wherein actuation of the quick-release member causes a pawl of the ratchet assembly to disengage from teeth of the ratchet assembly.

15. A C-clamp as in claim 1, wherein pulling on an end of the threaded rod causes the threaded rod to slide toward the workpiece.

16. An adjustable C-clamp, comprising:

a main body;

a threaded rod movably attached to main body, wherein the threaded rod includes a lever at an end portion;

an actuator; and a ratchet mechanism that mechanically couples the rod to the actuator, wherein actuation of the actuator drives the ratchet mechanism to cause axial movement of the rod toward or away from a workpiece and wherein actuation of the lever rotates the threaded rod to cause movement of the rod toward or away from the workpiece.

17. A C-clamp as in claim 16, wherein the actuator comprises a handle and wherein actuation of the actuator comprises squeezing the handle toward the main body.

18. A C-clamp as in claim 16, wherein the actuator can be actuated using a single hand.

19. A C-clamp as in claim 16, further comprising a gear assembly connecting the ratchet mechanism to the rod.

20. A C-clamp as in claim 19, wherein the ratchet mechanism includes teeth that couple to the gear assembly, which couples to threads on the rod.

21. A C-clamp as in claim 16, wherein the ratchet mechanism includes a pawl arm and a pawl, wherein the pawl arm is movable between two positions including a first position that causes clockwise movement of ratchet mechanism, and a second position that causes counterclockwise movement of ratchet mechanism.

22. A C-clamp as in claim 16, wherein the threaded rod includes a plunger at a second end portion and wherein the plunger is movable relative to the threaded rod.

23. An adjustable C-clamp, comprising:

a main body;

a threaded rod movably attached to main body;

an actuator;

a ratchet mechanism that mechanically couples the rod to the actuator, wherein actuation of the actuator drives the ratchet mechanism to cause axial movement of the rod toward or away from a workpiece;

a quick-release member, wherein actuation of the quick-release member causes the ratchet mechanism to uncouple from the rod so that the rod can move freely toward or away from the workpiece; and a gear assembly coupled between the ratchet mechanism and the threaded rod, wherein the gear assembly is configured to rotate on an axis that is substantially perpendicular to a longitudinal axis of the threaded rod.

24. A C-clamp as in claim 23, wherein the ratchet mechanism includes teeth that couple to the gear assembly and wherein the gear assembly includes external teeth that couples to external threads on the rod.

* * * * *

UNITED STATES PATENT AND TRADEMARK OFFICE

CERTIFICATE OF CORRECTION

PATENT NO. : 8,025,279 B2
APPLICATION NO. : 12/170781
DATED : September 27, 2011
INVENTOR(S) : Seber It is certified that error appears in the above-identified patent and that said Letters Patent is hereby corrected as shown below:

In the Claims:

Column 8, Claim 1, Line 61, please delete "pear" and insert --gear-- therefor.

Signed and Sealed this
Thirteenth Day of March, 2012

David J. Kappos

David J. Kappos
*Director of the United States Patent and Trademark Office*